United States Patent [19]

Lucas

[11] Patent Number: 4,490,929

[45] Date of Patent: Jan. 1, 1985

[54] GRADING APPARATUS AND FRAMEWORK THEREFOR

[76] Inventor: Geoffrey Lucas, R.M.B. 1090, Beechworth, Victoria, Australia

[21] Appl. No.: 471,155

[22] Filed: Mar. 1, 1983

[30] Foreign Application Priority Data

Mar. 2, 1982 [AU] Australia ..... PF2917

[51] Int. Cl.[3] ..... E02F 5/00

[52] U.S. Cl. ..... 37/129; 172/799.5

[58] Field of Search ..... 172/799.5, 4.5; 37/124, 37/129

[56] References Cited

U.S. PATENT DOCUMENTS

| | | | |
|---|---|---|---|
| 1,339,548 | 5/1920 | Cox | 172/799.5 X |
| 1,911,511 | 5/1933 | Jordan | 37/129 |
| 2,015,880 | 10/1935 | Wold | 37/129 |
| 2,582,032 | 1/1952 | Harmon et al. | 37/129 |
| 2,841,898 | 7/1958 | Sampson | 37/129 X |
| 2,992,537 | 7/1961 | Callahan | 37/98 X |
| 3,261,118 | 7/1966 | Litherland | 172/799.5 X |
| 4,189,009 | 2/1980 | Welch | 172/799.5 |
| 4,217,962 | 8/1980 | Schaefer | 172/799.5 X |
| 4,393,608 | 7/1983 | Hodge | 37/124 |

FOREIGN PATENT DOCUMENTS

| | | | |
|---|---|---|---|
| 576369 | 10/1977 | U.S.S.R. | 172/799.5 |

*Primary Examiner*—Clifford D. Crowder

*Attorney, Agent, or Firm*—Cushman, Darby & Cushman

[57] ABSTRACT

Land grading apparatus comprising earth cutting blade mounted on wheeled carrier intended to be towed behind prime mover. Blade is fitted to elongate framework extending transversely of towing direction and comprising elongate blade carrier, two parallel tubes disposed above and to the rear of the blade carrier, two framework end structures and stiffening members. Carrier comprises a wheeled axle extending across apparatus behind the framework. Framework is suspended from a beam extending over midpart of framework longitudinally of towing direction. Beam is connected at front end to towing bar for connection to prime mover and is supported at rear end from the axle by hydraulic ram operable to raise and lower framework.

6 Claims, 7 Drawing Figures

GRADING APPARATUS AND FRAMEWORK THEREFOR

BACKGROUND OF INVENTION

This invention relates to land grading apparatus of the kind comprising an earth cutting blade structure mounted on a wheeled carrier intended to be towed behind a prime mover vehicle for land grading operations. The invention has particular, but not exclusive, application to apparatus of this kind in which the earth cutting blade is positioned automatically relative to a reference plane established by a laser transmitter. Presently known graders of the kind which are towed behind prime mover tractors are fitted with cutter blades and earth collecting buckets surrounded by massive perimeter frames. They are extremely heavy and require very powerful tractors to be operated satisfactorily. By the present invention it is possible to provide an apparatus which is relatively light in weight but which is immensely strong and can accurately grade over a large working width.

SUMMARY OF INVENTION

According to the invention there is provided land grading apparatus of the kind comprising an earth cutting blade structure mounted on a wheeled carrier intended to be towed behind a prime mover vehicle for grading operations, wherein the earth cutting blade structure is in the form of an elongate structure extending transversely of the direction in which the carrier is to be towed and is incorporated in a rigid elongate framework also comprising a first elongate member spaced above the cutting blade structure in generally parallel relationship therewith, a second elongate member spaced rearwardly from the cutting blade structure with reference to the towing direction in generally parallel relationship with the cutting blade structure, and a pair of framework end structures each interconnecting the ends of the cutting blade structure and the said elongate members at a respective end of the framework.

Preferably, the first and second elongate members are tubular and the framework is stiffened by stiffening members extending between the cutter blade structure and the second elongate member. These stiffening members may be in the form of a series of struts spaced longitudinally of the cutting blade structure and the second elongate member.

Preferably, the carrier comprises a wheeled axle extending across the apparatus behind said framework and the framework is suspended from a beam extending over the midpart of the framework longitudinally of the towing direction, which beam is supported at its rear end from said axle via a fluid ram unit and is pivotally connected at its forward end to an elongate rigid member for connection to the towing vehicle, whereby, in operation of the apparatus, the framework can be raised and lowered relative to the ground by operation of the ram unit. Draught chains, cables, or the like may be attached to the framework in the vicinity of the cutting blade.

Preferably too, there are linkage connections between the rear axle and the second elongate member of said framework effective to resist rearward movement of the framework relative to the axle but permitting raising and lowering movements on operation of the ram unit.

Preferably further, one of the linkage connections is positioned at or toward one end of the framework and incorporates means operable to raise and lower that end of the framework to enable lateral trimming of the cutter blade structure.

BRIEF DESCRIPTION OF DRAWINGS

In order that the invention may be more fully explained one particular embodiment will be described in some detail with reference to the accompanying drawings, in which.

DESCRIPTION OF PREFERRED EMBODIMENT

Figure 1:
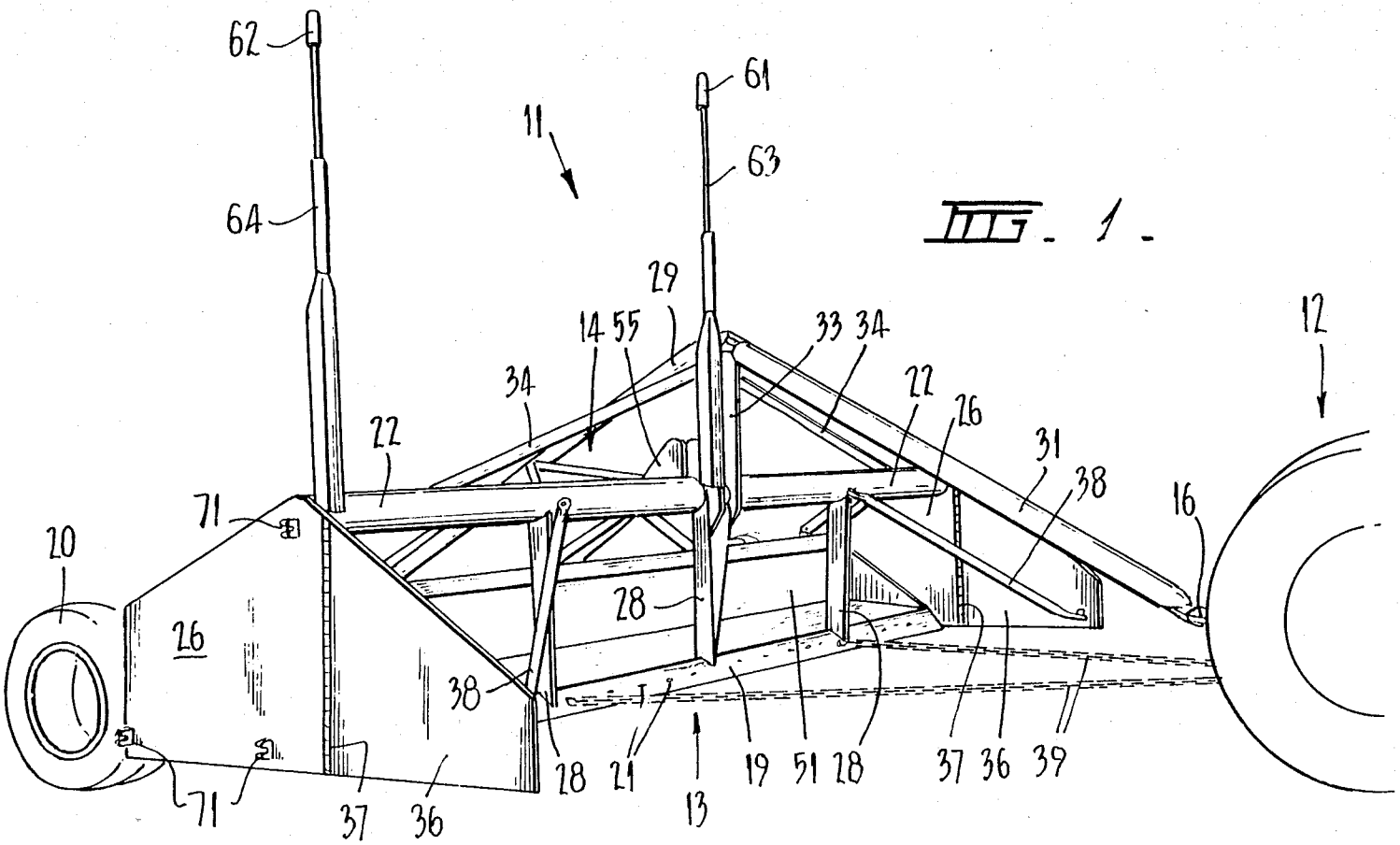
FIG. 1 is a front perspective view of a land grading apparatus constructed in accordance with the invention and connected to the rear of a towing tractor.
Figure 2:
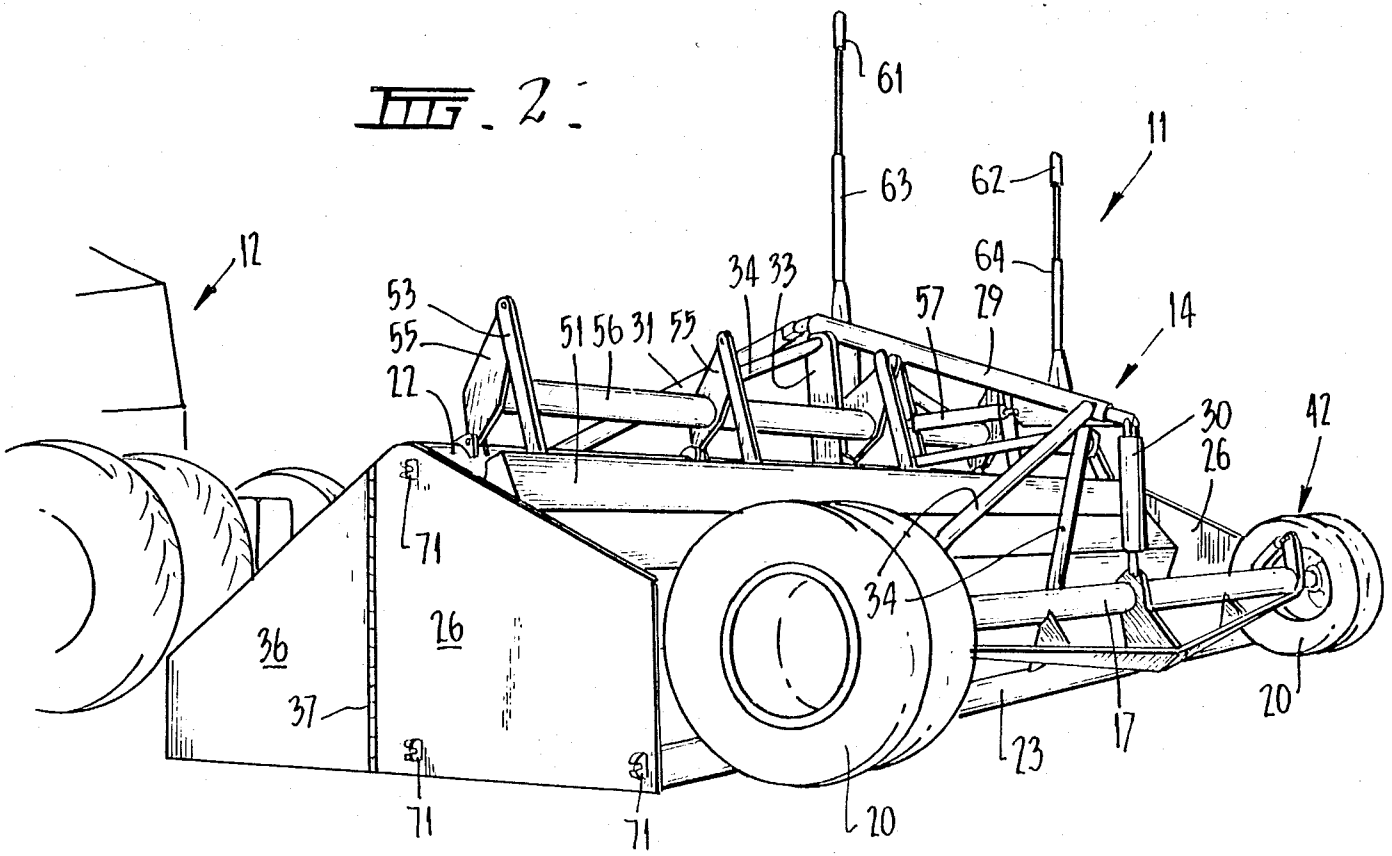
FIG. 2 is a rear perspective view of the grading apparatus shown in FIG. 1.
Figure 3:
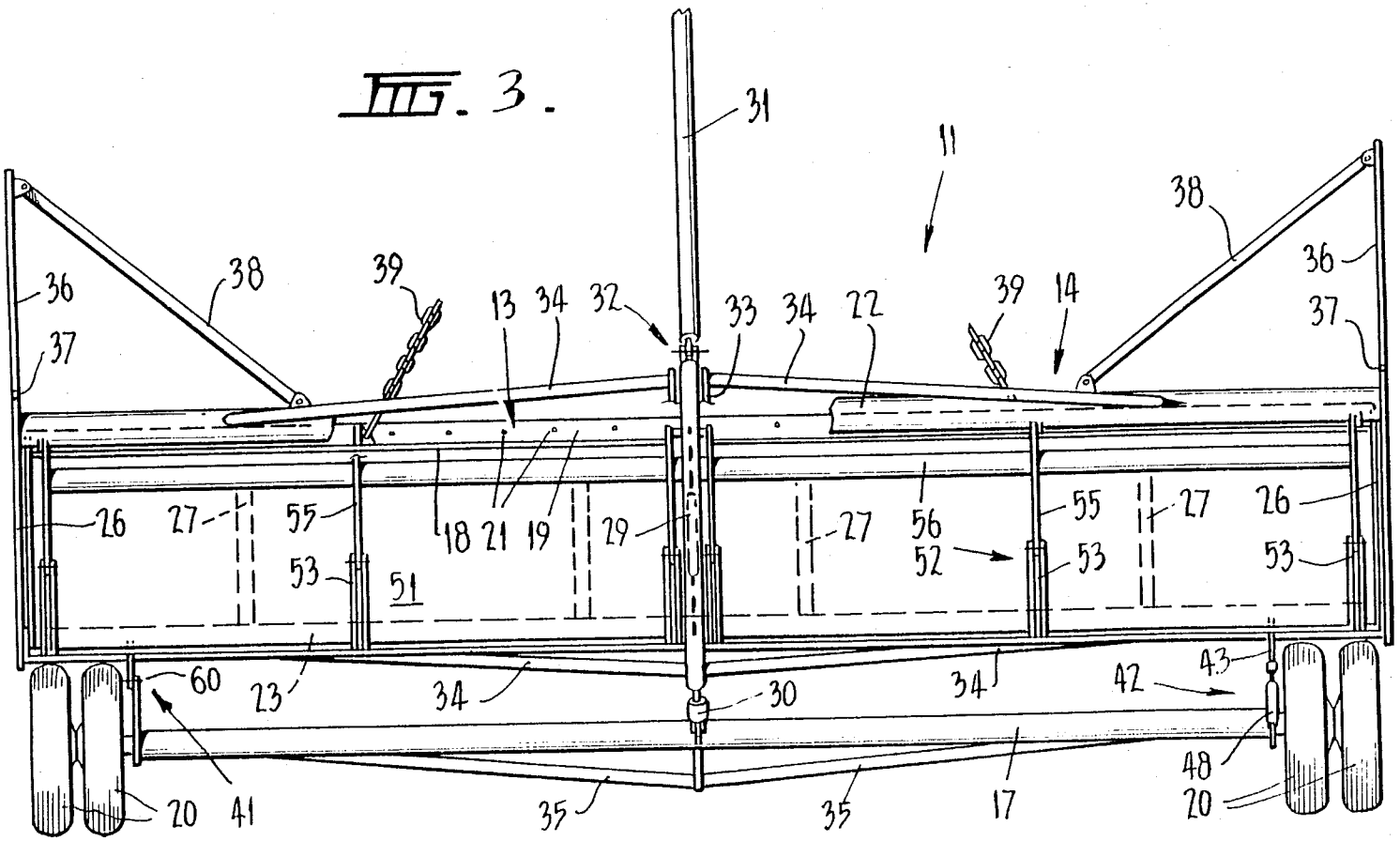
FIG. 3 is a plan of the apparatus.
Figure 4:
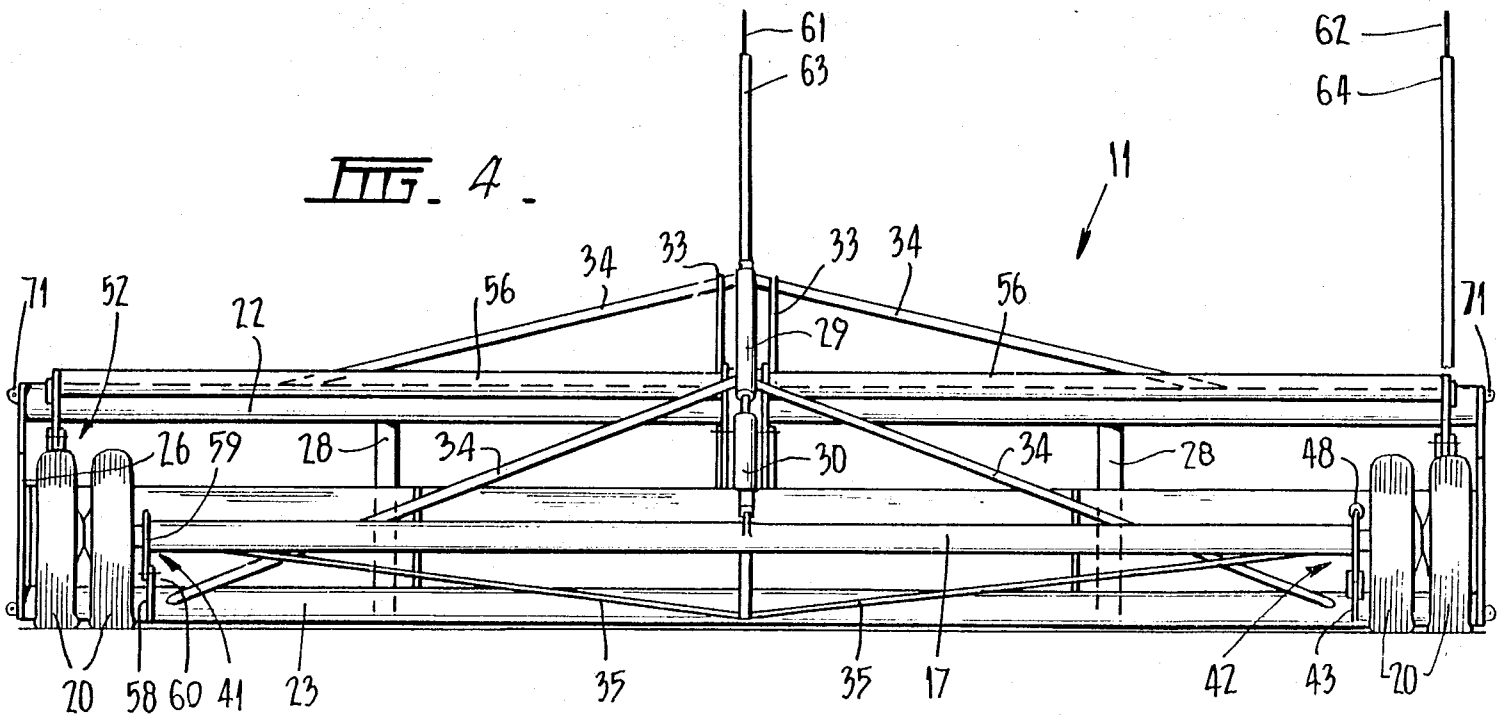
FIG. 4 is a rear elevation.

The drawings show a land grading apparatus denoted generally as 11 connected behind a towing vehicle 12. The grading apparatus 11 comprises an elongate blade structure 13 forming part of a transversely extending elongate framework denoted generally as 14. Framework 14 is suspended from a central support structure denoted generally as 15 extending from the draw bar 16 of the tractor to an axle 17 which extends across the rear of the apparatus behind the framework and is supported at its ends on ground wheels 20.

Cutter blade structure 13 comprises a blade support member 18 formed of angle iron and blade elements 19 connected to member 18 by bolt and nut connections 21. The framework 14 is further comprised of an upper tubular member 22 disposed directly above the cutter blade structure and extending parallel to it and a rear tubular member 23 spaced rearwardly from the cutter blade structure. It has a pair of end structures in the form of plates 26 which interconnect the ends of the cutter bar structure and the two tubular members 22, 23 at the two ends of the framework. The framework is stiffened by a series of horizontal struts 27 extending between the cutter blade support member 18 and the rear tubular member 23 and three upright struts 28 connected between the cutter blade support member and the upper tubular member 22.

Central support structure 15 comprises a main support beam 29, a hydraulic ram unit 30 connected between the rear axle 17 and the rear end of the support beam 29 and a long rigid pole 31 connected by a two-way hinge 32 to the front end of support beam 29 and extending downwardly and forwardly to a connection with the draw bar 16 of the towing tractor. Framework 14 is suspended from the front end of support beam 29 through a pair of massive support brackets 33 and lateral stiffening is provided by front and rear angle supports 34. The rear axle is braced by truss members 35.

A pair of wing plates 36 are hinged to the end plates 26 of framework 14 by hinges 37. During grading operations these wing plates are held by braces 38 so as to form forwardly extending wing extensions of the end plate 26, but on disconnection of braces 38 they can be folded inwardly for transport of the apparatus as will be described hereinafter.

A pair of draught chains 39 are connected to the framework 14 in the vicinity of the cutter blade. In operation of the apparatus these chains are connected to the tow bar of the towing tractor to provide the towing draught forces.

By operation of the main ram 30, beam 29, and with it the whole of framework 14, can be raised and lowered. Thus the depth of cut of the cutter blade can be controlled by operation of the main ram. A pair of linkages 41, 42 are connected between the rear tubular member 23 of framework 14 and the rear axle 17 one at each end of the axle so as to provide supports for the framework but to permit the framework to rise and fall on operation of ram 30. Linkage 41 comprises a link 58 connected to the rear tubular member 23 of framework 14, a link 59 connected to the rear axle 17 and a pivot pin 60 pivotally connecting the two links together. The other linkage mechanism 42 comprises a pair of links 43, 44 fastened to the tubular member 23 and the rear axle and connected by a toggle lever 45 which is connected to the links by pivot pins 46 and 47 and is actuable by a hydraulic ram unit 48. The ram unit is pivotally connected between the outer end of the toggle lever and an arm 49 formed as extension of the link frame. Operation of ram unit 48 causes one end of the framework to be raised and the other end to be lowered simultaneously whereby the lateral trim of the cutter blade can be adjusted.

Framework 14 supports an open fronted sheet metal bucket 51 to collect earth cut by the cutter blade. Bucket 51 is hinged at its forward end to the rear of the cutter blade support member 18 and it can be raised and lowered by operation of a linkage system 52 provided on the centre line of the apparatus.

Linkage system 52 comprises a series of lift links 53 pivotally connected between the top of the bucket and a series of lift arms 55 which are interconnected by a long tube 56. The lift arms at the centre line of the machine have extensions which provide a crank arm for the operation of a bucket lifting ram 57 which is connected at its rear end to a lug 68 depending from the main support beam 29.

Figure 5:
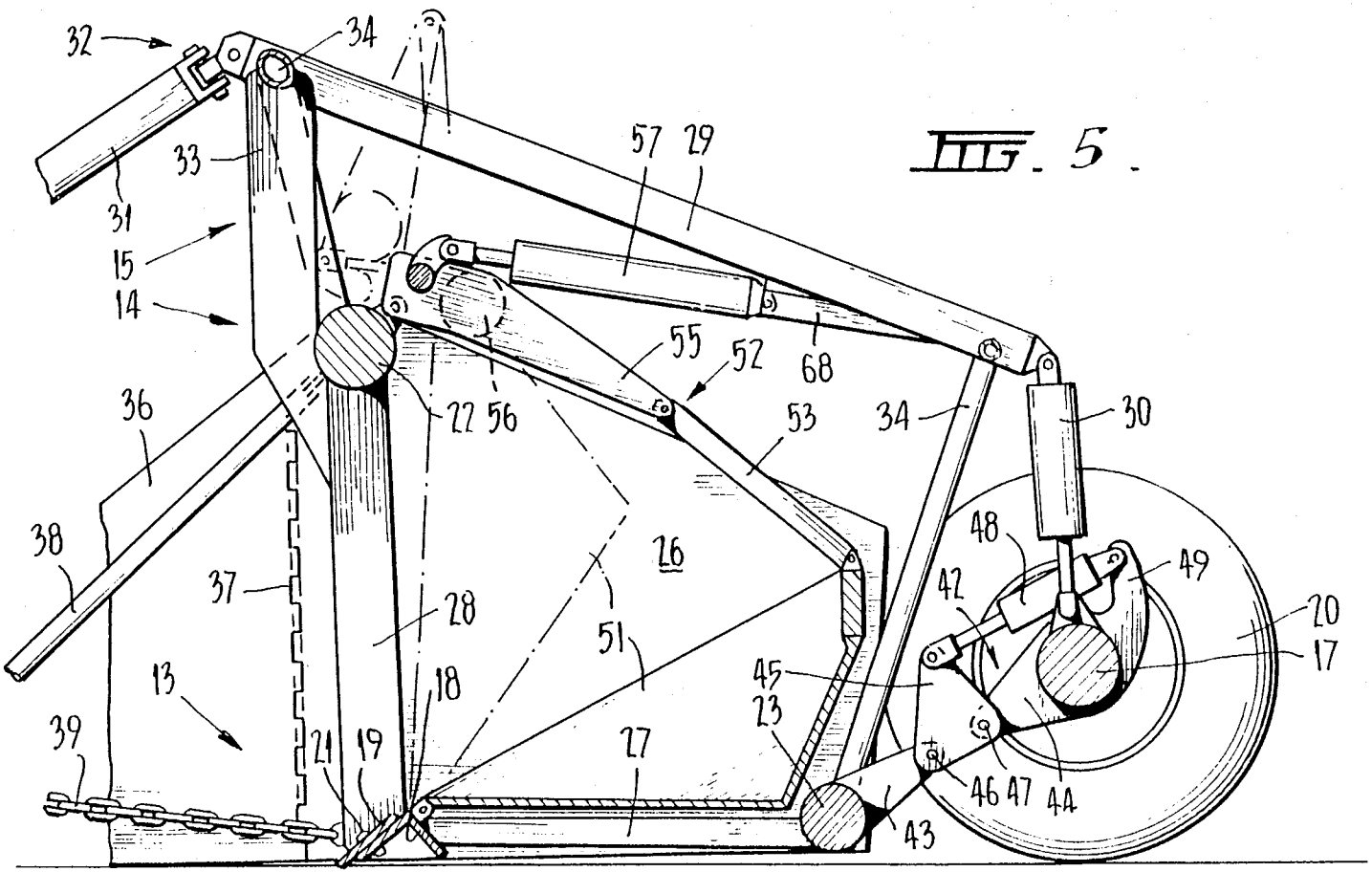
FIG. 5 is a diagrammatic elevation of the main components of the apparatus.
Figure 6:
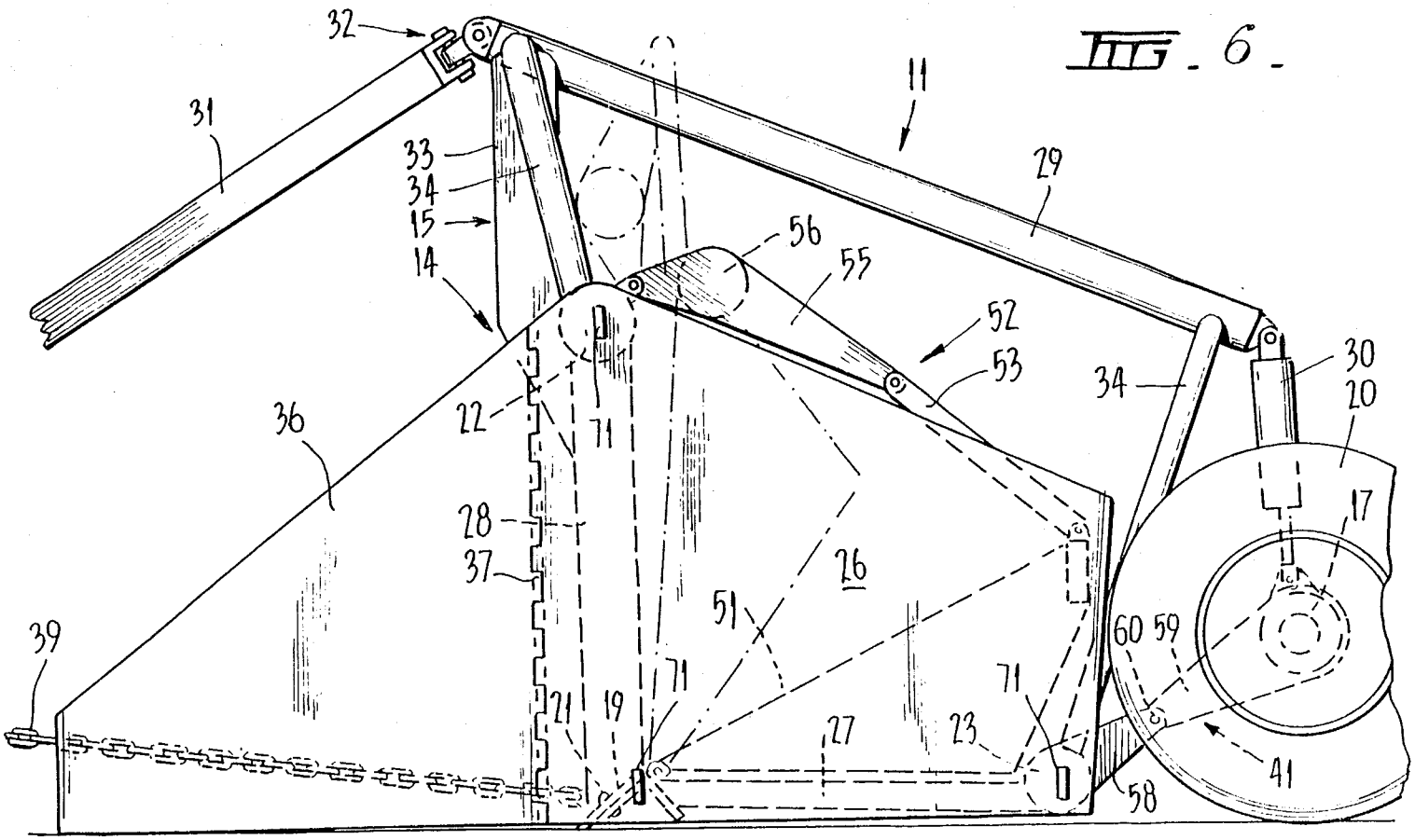
FIG. 6 is an end elevation of the apparatus.

By operation of ram 57, the earth receiving bucket can be raised from its normal lowered position to the raised position indicated in dotted outline in FIG. 5 when soil collected during grading operations is to be discharged.

The apparatus may be fitted with two laser receivers 61, 62 mounted on poles 63, 64 to detect a reference plane established by a laser transmitter and to automatically set the blade according to that reference plane. Receiver 61 may be connected to the main ram unit 30 to control the main raising and lowering movements of the cutting blade and receiver 62 may control the operation of the trimming ram unit 48 to provide lateral trimming of the blade. The lateral trimming facility enables the grader to operate on a correct grade where unwanted crossfall exists. It also enables a correct grading attitude to be maintained even when uneven loading across the blade or the bucket generates tyre, soil and frame deflections.

Although of relatively lightweight construction the illustrated apparatus is immensely strong and it is capable of grading effectively over large working widths. The geometry of the apparatus is such that the blade is held in the required position because of the great torsional stiffness of the framework 14 backed up by the linkage connections to the rear axle which is also very strong in torsion.

Figure 7:
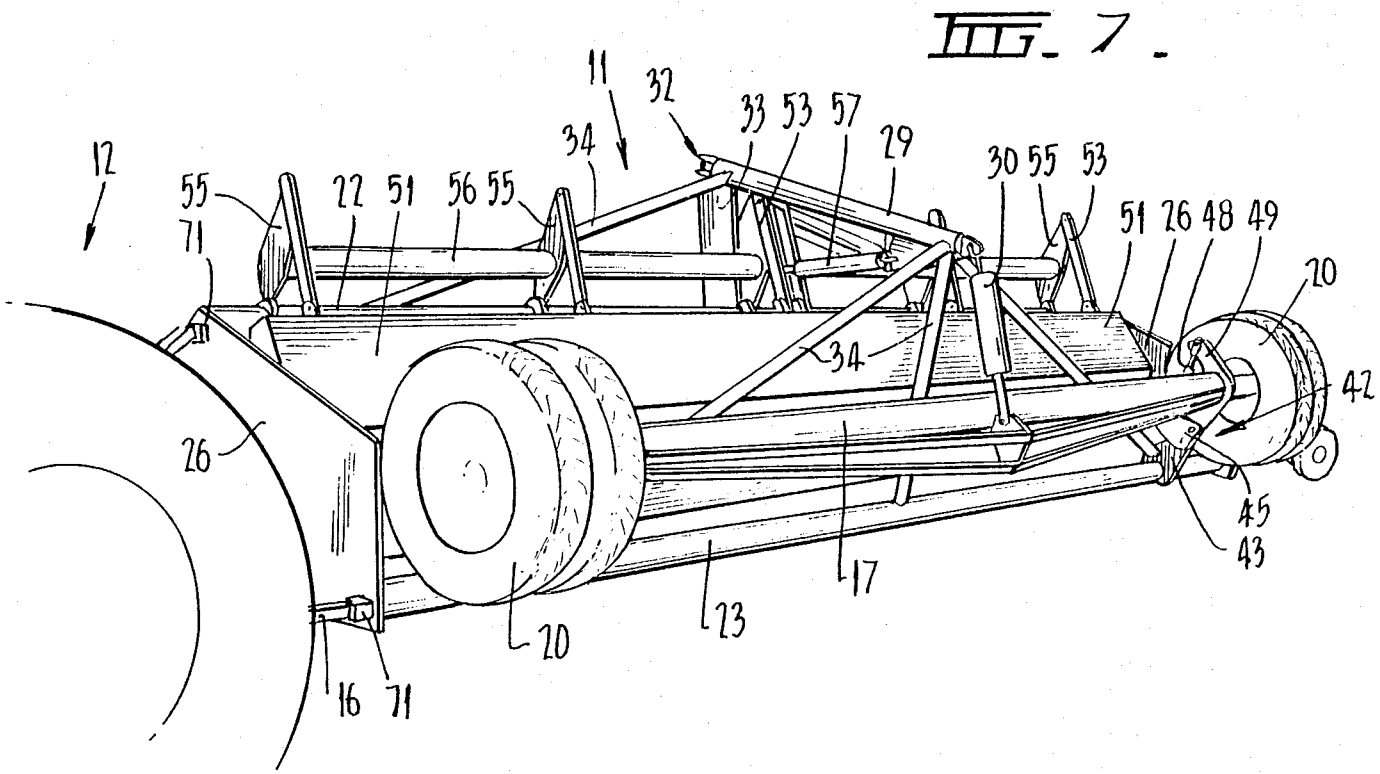
FIG. 7 is a perspective view of the apparatus in a transport condition.

Because of its generally wide, narrow geometry the apparatus can readily be towed end-on for transport between the grading operations. For this purpose transport wheels are connected to the end of the framework 14 via mounting lugs 71 and the wing plates 36 are folded in against the framework. The double hinge 32 enables pole 31 to be simply swung through 90° to permit end-on towing as illustrated in FIG. 7. The framework 14 can be made in any length without altering its longitudinal cross-section so that it is a simple matter to produce a range of machines of differing working widths all of which can easily be towed end-on on roads and through gateways.

It is to be understood that the invention is in no way limited to the details of the specific construction illustrated in the drawings and that many modifications and variations will fall within the scope of the appended claims.

I claim:

1. Land grading apparatus of the kind comprising an earth cutting blade structure mounted on a wheeled carrier intended to be towed behind a prime mover vehicle for grading operations, wherein the earth cutting blade structure comprises an earth cutting blade and an earth carrying means positioned behind the earth cutting blade, the earth cutting blade structure being in the form of an elongate structure extending transversely of the direction in which the carrier is to be towed and is incorporated in a rigid elongate framework also comprising a first elongate member spaced above the cutting blade structure in generally parallel relationship therewith, a second elongate member spaced rearwardly from the cutting blade structure with reference to the towing direction in generally parallel relationship with the cutting blade structure, and a pair of framework end structures each interconnecting the ends of the cutting blade structure and the said elongate members at a respective end of the framework, the carrier comprising a wheeled axle extending across the apparatus behind said framework and the framework being suspended from a beam extending over the midpart of the framework longitudinally of the towing direction, which beam is supported at its rear end from said axle via a fluid ram unit and is pivotally connected at its forward end to an elongate rigid member that is separate to the framework for connection to the towing vehicle, whereby, in operation of the apparatus, the framework can be raised and lowered relative to the ground by operation of the ram unit, and elongate draught elements for connection to the towing vehicle are attached to the framework in the vicinity of the cutting blade.

2. Land grading apparatus as claimed in claim 1, wherein said first and said second members of the framework are tubular, the framework is stiffened by stiffening members extending between the cutter blade structure and the second elongate member and a series of struts extending between the cutting blade structure and the first elongate member.

3. Land grading apparatus as claimed in claim 1, wherein there are linkage connections between the rear axle and the second elongate member of said framework effective to resist rearward movement of the framework relative to the axle but permitting raising and lowering movements of the framework on operation of the ram unit.

4. Land grading apparatus of the kind comprising an earth cutting blade structure mounted on a wheeled carrier intended to be towed behind a prime mover vehicle for grading operations, wherein the earth cutting blade structure comprises an earth cutting blade and an earth carrying means positioned behind the cutting blade, the earth cutting blade structure being in the form of an elongate structure extending transversely of the direction in which the carrier is to be towed and is incorporated in a rigid elongate framework also comprising a first elongate tubular member spaced above the cutting blade structure in generally parallel relationship therewith, a second elongate tubular member spaced rearwardly from the cutting blade structure with reference to the towing direction in generally parallel relationship with the cutting blade structure, and a pair of framework end structures each interconnecting the ends of the cutting blade structure and said tubular members at a respective end of the framework; wherein the carrier comprises a wheeled axle extending across the apparatus behind said framework and the framework is suspended from a beam extending over a midpart of the framework longitudinally of the towing direction, which beam is supported at its rear end from said axle via a fluid ram unit and is pivotally connected at its forward end to an elongate rigid member for connection to the towing vehicle whereby, in operation of the apparatus, the framework can be raised and lowered relative to the ground by operation of the ram unit; and wherein there are linkage connections between the rear axle and the second elongate tubular element of the framework effective to resist rearward movement of the framework relative to the axle but permitting raising and lowering movements of the framework on operation of the ram unit, one of the linkage connections being positioned to one end of the framework and incorporating actuator means such that it is actuable to raise and lower that end of the framework to enable lateral trimming of the cutter blade structure.

5. Land grading apparatus as claimed in claim 4, wherein said one linkage connection comprises first and second links rigidly connected respectively to the rear axle and to the second elongate member of said framework, and a toggle lever pivotally connected between the first and second links and actuable by the actuator means.

6. Land grading apparatus as claimed in claim 4, wherein said framework carries a bucket to collect soil cut during grading operations and means actuable to tilt the bucket on the framework to discharge collected soil.

* * * * *